United States Patent [19]

Heffington, Jr.

[11] 4,391,438

[45] Jul. 5, 1983

[54] PATIENT SUPPORT ATTACHMENT FOR SURGICAL TABLES

[76] Inventor: Charles A. Heffington, Jr., 123 E. College St., Murfreesboro, Tenn. 37130

[21] Appl. No.: 273,210

[22] Filed: Jun. 12, 1981

[51] Int. Cl.[3] ..... A61G 13/00

[52] U.S. Cl. ..... 269/328

[58] Field of Search ..... 5/431, 443, 444; 128/133, 134; 269/322–328

[56] References Cited

U.S. PATENT DOCUMENTS

| | | | |
|---|---|---|---|
| 998,996 | 7/1911 | Swenson et al. | 5/444 |
| 1,626,091 | 4/1927 | Macklin | 269/326 |
| 2,257,491 | 9/1941 | Armstrong | 269/322 |
| 2,577,177 | 12/1951 | Anderson | 269/322 |
| 2,819,133 | 1/1958 | Party | 269/328 |
| 3,643,938 | 2/1972 | Levasseur | 269/328 |
| 3,710,783 | 1/1973 | Jascalevich | 269/328 |

FOREIGN PATENT DOCUMENTS

| | | | |
|---|---|---|---|
| 1211788 | 1/1959 | France | 269/328 |

*Primary Examiner*—Robert C. Watson

*Attorney, Agent, or Firm*—B. P. Fishburne, Jr.

[57] ABSTRACT

To facilitate certain spinal surgery requiring the patient to be in a prone sitting position, a simplified and comparatively inexpensive support attachment for operating tables is provided having a greater range of adjustments and requiring fewer parts. The attachment consists of two support rods held in clamps on opposite sides of the table and engaging two like clamps on opposite sides of a padded support panel for the buttocks and upper thigh region of the patient. The support panel is held in spaced relationship to one end of the table.

5 Claims, 3 Drawing Figures

FIG. 1
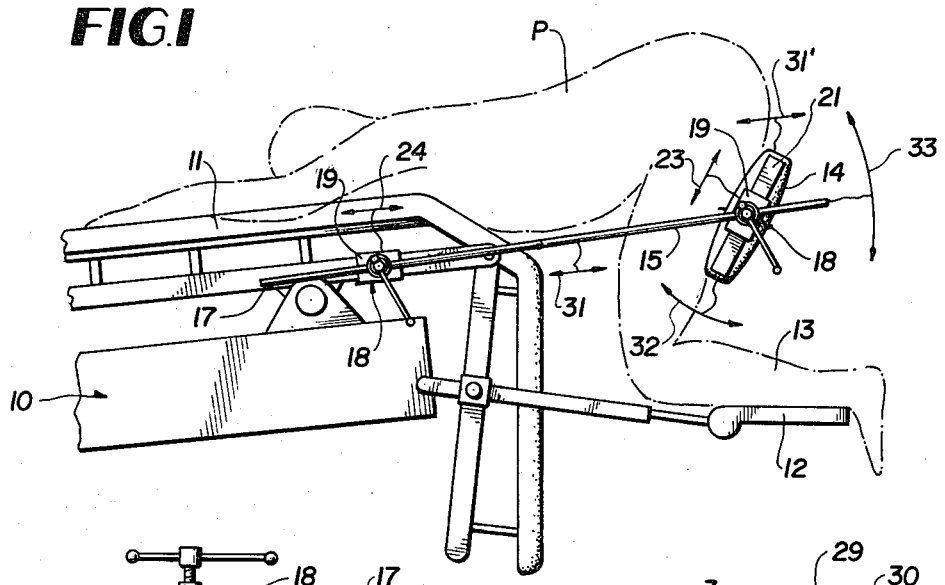
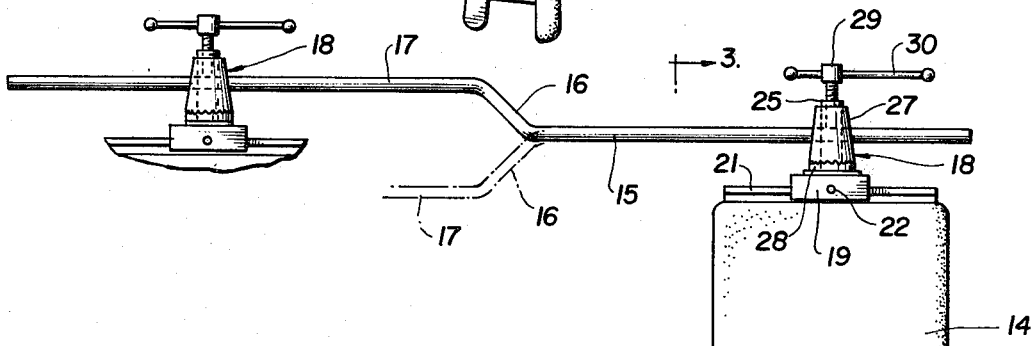
FIG. 2
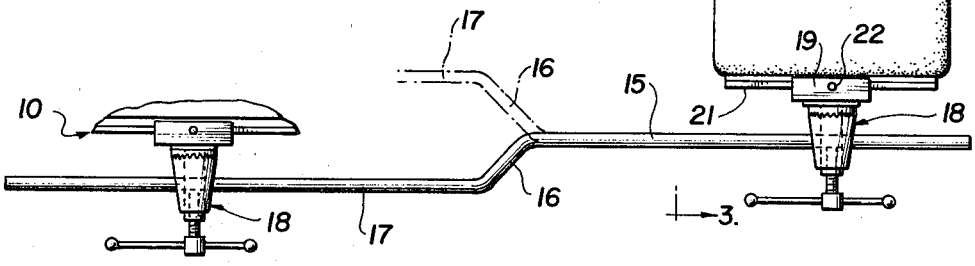
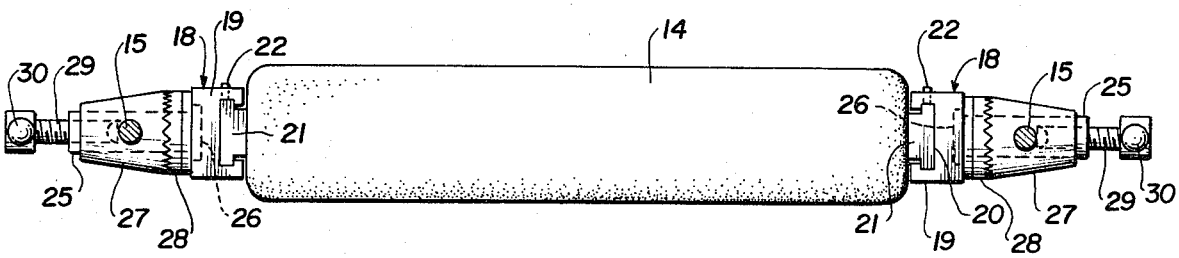
FIG. 3

PATIENT SUPPORT ATTACHMENT FOR SURGICAL TABLES

BACKGROUND OF THE INVENTION

Certain classes of surgery require a patient to be supported in what may be termed a prone sitting position. In such position, the abdomen and lower chest regions are essentially unsupported while the shoulder region, buttocks and thighs are firmly supported and braced against movement. The lower legs are bent to a kneeling position and are also supported by a lower level platform attached to or forming a part of the operating table. Devices of this general character are known in the prior art and examples of the prior art are shown in U.S. Pat. Nos. 2,577,177; 3,197,198 and 3,643,938. A somewhat similar commercial prior art device or attachment is marketed by Medical Specialties, Inc., 4911 Wilmont Rd., Charlotte, N.C. 28208, called the Hicks Spinal Surgery Frame.

Devices or attachments of this type reduce spinal surgery time and facilitate difficult surgery by permitting wider exposure of the spine. Better ventilation of the patient is enabled by a more freely movable diaphragm. Vena caval pressure is eliminated during surgery, thus minimizing epidural venus bleeding and facilitating visualization. The device also seeks to stabilize the patient during surgery.

The prior art attachments or devices for this purpose, while successful in varying degrees, possess certain drawbacks which the present invention seeks to eliminate. Excessive cost of manufacturing, general complexity, an insufficient range of adjustability and inadequate support and stabilization of the patient's buttocks and thighs are among the defects of the known prior art which this invention totally eliminates.

Not only does the invention eliminate these drawbacks or defects, but does so with a much simpler and less expensive attachment, and one which has a considerably greater range of adjustability so that it can satisfy the diverse needs of different individual patients. The number of parts necessary for the attachment has been minimized in the invention and the attachment has been constructed for easy installation on almost all operating tables. Furthermore, the support attachment can have its components quickly separated to facilitate compact shipment or storage. Better surgery is enabled.

Additional features and advantages of the invention will appear to those skilled in the art during the course of the following description.

BRIEF DESCRIPTION OF THE DRAWINGS

FIG. 1 is a side elevation of a patient support attachment for operating tables according to the invention.

FIG. 2 is a plan view of the attachment.

FIG. 3 is a transverse vertical section taken on line 3—3 of FIG. 2.

DETAILED DESCRIPTION

Referring to the drawings in detail wherein like numerals designate like parts, the numeral 10 designates a typical conventional operating table on which the invention is used. This table includes a support surface 11 for the shoulders, head and arms of a patient P who is to undergo spinal surgery while in a prone sitting position with the abdomen and lower chest essentially unsupported. The operating table 10 also includes a conventional adjustable platform 12 at a lower elevation to support the lower legs 13 of the patient, as illustrated.

The support attachment forming the subject matter of this invention comprises a padded rectangular rigid panel 14 of a size to support and stabilize the buttocks, thighs of the largest adult patient normally encountered. The support panel 14 is adjustably connected with a pair of identical stainless steel rods 15 having short lateral portions 16 near their midpoints leading to longitudinal extensions 17.

A first pair of swivel clamps 18 detachably secured to opposite sides of the operating table receive and hold the extensions 17 adjustably, while a second pair of the identical clamps 18 receive and hold the rods 15 adjustably, as indicated in the drawings.

The clamps 18 per se are conventional and are of the type shown at 18 in U.S. Pat. No. 3,643,938. They are well known in the art as Clark sockets. Briefly, each clamp 18 has a base 19 having a T-passage 20 formed therethrough for the reception of a straight track member 21 of like cross sectional shape on the support panel 14 and on the operating table 10. A locking set screw 22 is provided to rigidly lock the clamp base 18 in the selected adjusted position along the track member 21 of the panel 14 and operating table, thereby providing an adjustment of the panel along the track members 21 in the direction of the arrows 23 and a similar adjustment of the entire attachment on the operating table in the direction of the arrows 24.

Each clamp, FIG. 3, further comprises an interior element 25 having a head 26 at its inner end, first and second toothed jaw members 27 and 28, and an axial clamping screw 29 having a turning handle 30. The elements 25 and 27 of each clamp are apertured across the axis of the clamping screw 29 to receive the rods 15 adjustably or their offset extensions 17.

By loosening the clamp screw 29 which is threaded into the element 25, the rods 15 or their extensions 17 may be adjusted through the clamps 18 in the direction of the arrows 31 and locked in any selected adjusted position by the clamp screws. In the same manner, the support panel 14 is bodily adjustable along the rods 15 and lockable as shown by the arrows 31'.

Additionally, with sufficient loosening of the screws 29, the toothed jaw element 27 are rotatable incrementally about the axis of the screw 29 and relative to the opposing jaw element 27 of each clamp, followed by retightening of the screw 29. In this manner, the panel 14 is rendered adjustable on the axes of one pair of clamps 18 through a full 360 degrees as indicated by arrows 32. Similarly, the two arms or rods 15 are adjustable and lockable around the axes of the two clamps 18 on the operating table 10 as shown by the arcuate arrows 33. It may thus be seen that the support attachment has a large number of adjustments built into it, all of which may be achieved by utilization of the simple clamps 18.

By virtue of the short lateral portions 16 of the two support rods 15, the attachment can be applied to various operating tables having different widths, merely by rotating the portions 16 like crank arms around the axes of the rods 15 held by the clamps 18 of the panel 14. In this manner, the invention is applicable to substantially all known tables.

It can be seen that all stated objectives of the invention are achieved in a very simplified, sturdy and economical structure, the parts of which are easily separable from each other for storage and shipment. Furthermore, the attachment can be installed on an operating table in only a few moments of time and is easily removable therefrom. The advantages of the invention over the prior art should be apparent to those skilled in the art.

It should be noted that the two support rods 15 form a cantilever support for the panel 14 beyond one end of the operating table and the rotational adjustment of the device upwardly or downwardly on the arc 33 assures a proper elevation of the panel 14 in each case.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A patient support attachment for an operating table to facilitate surgery of the spine, the operating table having an end support portion for the arms, head and shoulders of a patient in a prone position and having an adjustable generally level support platform for the legs of a prone patient in a kneeling position with the support platform and legs spaced from the adjacent end of the operating table at an elevation below the level of said end support portion of the table, and the end support portion of the operating table carrying a pair of opposite side adjustable swivel clamps, said attachment comprising a pair of spaced substantially parallel longitudinally extending elongated support rods adjustably held in said opposite side swivel clamps of the table and extending for a substantial distance beyond the end support portion of the table in cantilevered relationship to the table, said support rods being longitudinally adjustable forwardly and rearwardly in said side swivel clamps of the table and being swingable upwardly and downwardly vertically around the transverse axes of the side swivel clamps and being lockable by such clamps in selected adjusted positions, a support panel for the buttocks and thighs of a patient disposed between said support rods in spaced relationship to said end support portion of the table and above the level of said support platform for the legs, and another pair of opposite side adjustable swivel clamps carried by said support panel for the buttocks and thighs and being adjustably engaged with and bodily supported by said support rods and also being adjustably engaged with said support panel, whereby the support panel for the buttocks and thighs may be moved forwardly or rearwardly along the longitudinal axes of the support rods, may be rotated in either direction around the transverse axes of the last-named pair of swivel clamps and may be shifted in opposite directions on a linear path across the rotational axis of said support panel as defined by the last-named swivel clamps and locked securely in a selected adjusted position on the support rods by the last-named swivel clamps, the body of a patient utilizing the attachment being substantially unsupported between the end support portion of the table and the support panel for the buttocks and thighs.

2. A patient support attachment for an operating table as defined in claim 1, and said support panel for the buttocks and thighs comprising a substantially rigid panel having padding at least on one side thereof.

3. A patient support attachment for an operating table as defined in claim 1, and said support rods having intermediate lateral offsets whereby the rods can be rotationally adjusted to fit operating tables of different widths.

4. A support attachment for operating tables particularly for patients undergoing spinal surgery comprising a pair of spaced substantially parallel elongated support rods adapted for connection adjustably near their forward ends to an operating table with the rods extending beyond one end of a table in cantilevered relationship thereto, adjustable means connecting the rods with a table and enabling the rods to be adjusted forwardly and rearwardly along their longitudinal axes and to have their rear ends swung upwardly or downwardly on an arcuate path in vertical planes and to be locked in selected adjusted positions relative to a table, a support panel for the buttocks and thighs of a patient disposed between rear end portions of the rods, and means adjustably connecting the support panel to the rods in such a manner that the support panel may be shifted forwardly and rearwardly on a linear path along the rods, may be rotated in two directions on an axis transverse to the rods and may be shifted in opposite directions on another linear path across the axis of rotation of the support panel, and the support panel being rigidly lockable in the selected adjusted position on the rods.

5. A support attachment for operating tables as defined in claim 4, and said adjustable means and said means comprising respectively a pair of swivel clamps on opposite sides of an operating table and a pair of swivel clamps on opposite sides of said support panel for the buttocks and thighs.

* * * * *